United States Patent [19]

McCarthy

[11] 4,222,857

[45] Sep. 16, 1980

[54] APPARATUS FOR SEPARATING SELECTED PARTICULATE MATERIALS FROM A MIXTURE OF SOLIDS AND LIQUIDS

[76] Inventor: James R. McCarthy, 623 Nevin Ave., Sewickley, Pa. 15143

[21] Appl. No.: 860,898

[22] Filed: Dec. 15, 1977

[51] Int. Cl.[2] ..... B03B 1/04; B03B 5/70

[52] U.S. Cl. ..... 209/9; 209/156; 209/18; 209/460

[58] Field of Search ..... 209/155, 156, 173, 18, 209/422, 458, 477, 3, 9, 166, 479–481; 210/532 R, 483, 488, 460; 302/14, 16

[56] References Cited

U.S. PATENT DOCUMENTS

| | | | |
|---|---|---|---|
| 461,652 | 10/1891 | Tyson | 209/458 |
| 510,474 | 12/1893 | Foley | 209/458 |
| 1,135,754 | 4/1915 | Bell | 209/458 |
| 1,521,787 | 1/1925 | Nesbitt | 209/156 |
| 2,174,553 | 10/1939 | Daman | 209/166 X |
| 2,236,165 | 3/1941 | Buskirk | 209/422 X |
| 2,267,496 | 12/1941 | Ellis | 209/166 |
| 2,293,111 | 8/1942 | Campbell | 209/166 X |
| 2,497,790 | 2/1950 | Pauvrasseau | 209/172.5 |
| 2,564,546 | 8/1951 | Schev | 209/155 X |
| 2,910,179 | 10/1959 | Svensson | 209/172.5 |
| 3,509,997 | 5/1970 | Tomlinson | 209/458 |
| 3,990,966 | 11/1976 | Stanley | 209/12 |
| 4,070,273 | 1/1978 | Morey | 209/166 X |
| 4,078,997 | 3/1978 | Wright | 209/458 |

FOREIGN PATENT DOCUMENTS

| | | | |
|---|---|---|---|
| 47430 | 8/1910 | Austria | 210/532 R |
| 609990 | 3/1932 | Fed. Rep. of Germany | 209/483 |
| Ad.21929 | 11/1920 | France | 210/532 R |
| 456895 | 11/1936 | United Kingdom | 209/155 |

*Primary Examiner*—Robert Halper

*Attorney, Agent, or Firm*—Buell, Blenko & Ziesenheim

[57] ABSTRACT

A chemical reagent is mixed with the mixture to form a resultant reaction mixture under substantially nonoxidizing or oxygen-free conditions. A continuous movement of the resultant reaction mixture is established through a flotation zone while maintaining substantially quiescent flow conditions during the continuous movement thereof. A first outlet is used to discharge a free or unimpeded flow of material collected at the upper surface of the liquid carrier medium within the flotation zone. A second outlet is used to discharge an impeded flow maintained at a lower flow rate than the free flow from said first discharging outlet. The chemical reagent is composed of a liquid hydrocarbon, a reducing material and an activator material. A trough shaped vessel has a discharge end with an upper outlet means and a lower outlet means. The vessel has a structural configuration effective to provide the continuous, substantially quiescent movement of the mixture through the vessel. Mineral value fines subject to having an oxygen-controlled surface condition constitute the selected particulate material being extracted from the mixture of liquids and solids. These selected materials include bituminous coal fines, anthracite coal fines, molybdenum sulfide values, sulfur and graphite.

20 Claims, 7 Drawing Figures

Fig. 1
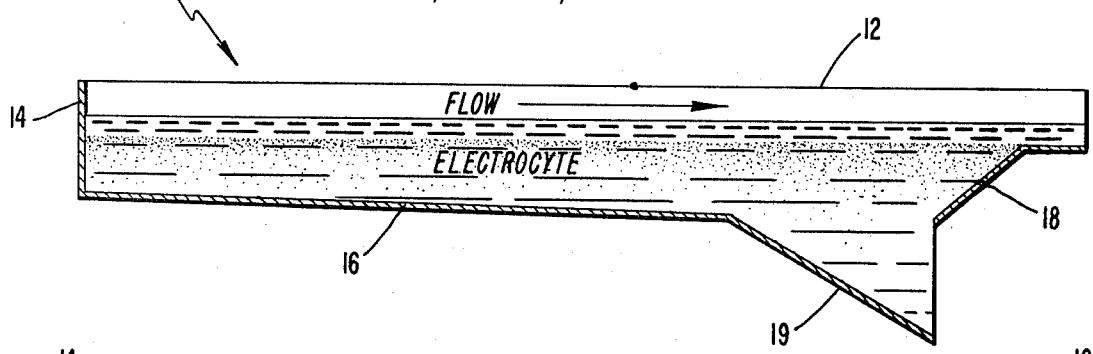
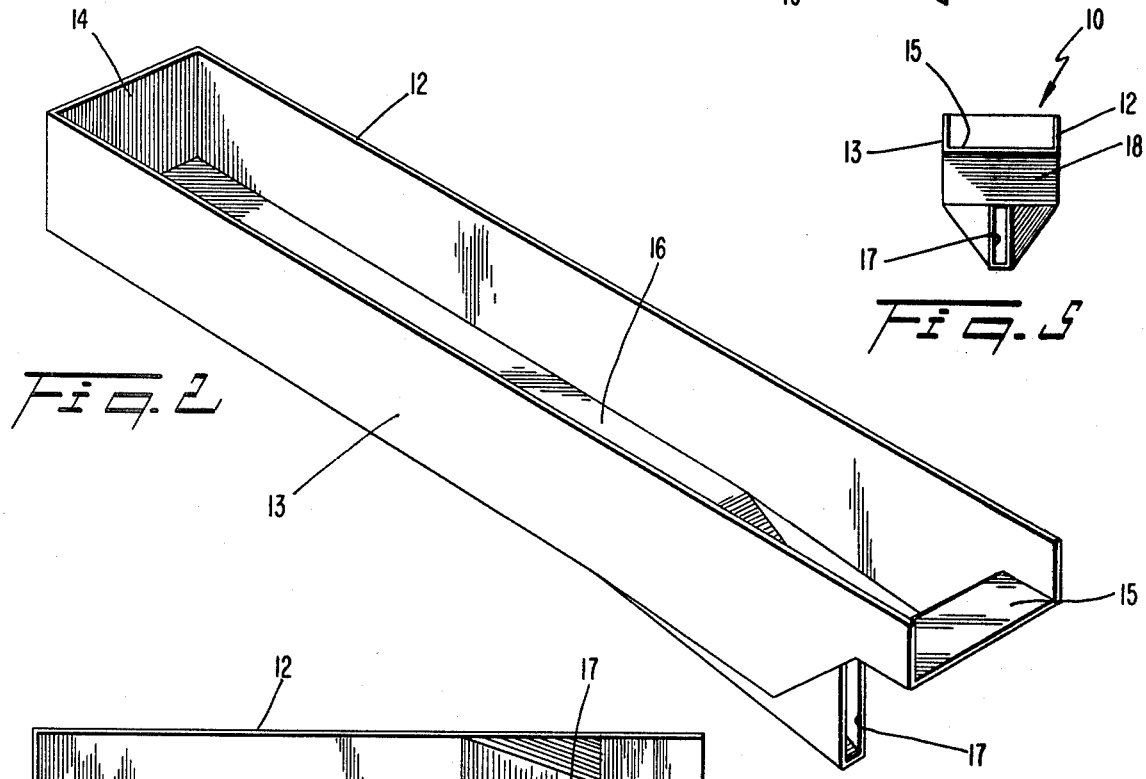
Fig. 2
Fig. 5
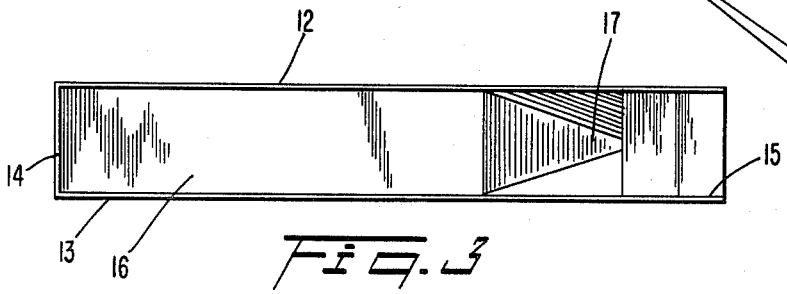
Fig. 3
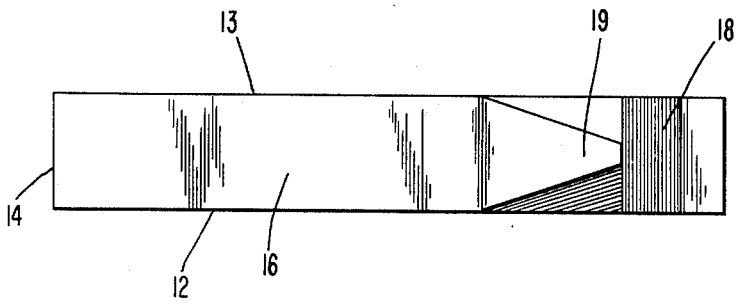
Fig. 4

APPARATUS FOR SEPARATING SELECTED PARTICULATE MATERIALS FROM A MIXTURE OF SOLIDS AND LIQUIDS

BACKGROUND OF THE INVENTION

This invention relates to the separation of selected particulate material from mixtures of liquids and solids. More particularly, the invention is directed to, an apparatus to effect the desired separation.

There are numerous known methods and systems for separating the selected particulate material from mixtures of liquids and solids. In many instances, this involves the simple classification of solid materials according to their densities as they flow through a vessel. U.S. Pat. Nos. 763,662, 805,382, 1,156,041, 1,425,187, 1,578,274, 1,593,232, 1,772,386, 2,198,915, 2,492,936 and 2,660,305 are deemed to represent the state of the art with respect to the effecting of separation of selected particulate materials from a mixture of liquids and solids. These patents represent the closest prior art related to the substance of the invention disclosed herein.

Various types of reagents, bath flotation systems, and froth flotation processes using various types of reagents are generally disclosed in these patents. The U.S. Pat. No. 1,578,274 discloses a method of treating particles of matter for separating same in an environmental condition which maintains the material under substantially nonoxidizing conditions. However, the specific reagents and the manner in which this is effected within a particular vessel, is completely different from the method and apparatus as disclosed herein. The complex apparatus is avoided through the use of the apparatus as disclosed herein. Furthermore, this particular prior art flotation process is completely different from that as set forth herein.

The various other prior art reagents disclosed in these U.S. patents operate in the presence of high oxygen environmental conditions, both from a chemical and a mechanical standpoint. Mechanically, the bubbling of air and the establishing of turbulence within the flotation zone aggravates the environmental flow conditions in which the selected particulate material is to be separated. Consequently, the mixture is subjected to oxygen. The presence of oxygen in the system establishes an oxygen-controlled surface condition on the particulate material selected for separation. Turbulence also upsets any desired intermolecular activity with respect to the establishment of electrostatic charges on the selected particulate material. Chemically, the reagents include oxygen which becomes available to react unfavorably with respect to the surface of the selected particulate material.

The U.S. Pat. No. 2,660,305 discloses an apparatus for classifying solid materials according to their various densities. The solids in this particular prior art method and apparatus are disposed in a liquid flowing in an open channel. The laws of gravity will cause the various solids having different specific gravities to collect in various layers or stratum locations. Thus, the materials flowing in an open channel will line up in accordance with their specific gravities. There are significiant amounts of turbulence in such a system, while establishing different rates of flow at varying heights of the open channel. This prior art methodology is referred to as lamellar flow used to separate solids according to their densities.

The physics of the most common sedimentation process—the settling of solid particles from fluid media—has long been known. The settling velocity equation formulated in 1851 by G. G. Stokes is the classic starting point for any discussion of the sedimentation process. Stokes showed that the terminal settling velocity of spheres in a fluid was directly proportional to the difference in densities of fluid and solid, the radius of spheres involved, and the force of gravity; and inversely proportional to the viscosity of the fluid. Stokes' equation is valid, however, only for spheres of very small size and, hence, various modifications of Stokes' Law have been proposed for nonspherical particles and particles of larger size.

No settling velocity equation, no matter how valid, provides a sufficient explanation of even the basic physical properties of natural sediments. The grain size of the classic elements and their sorting, the shape and roundness of these elements and their fabric and packing are a few parameters in complex processes. These parameters are related not only to the density and viscosity of the fluid medium, but also to the velocity of the forward motion of the depositing fluid and to the turbulence resulting from this motion, the roughness of the beds over which it moves, to various mechanical properties of the solid material propelled, to the time or duration of the transport action, etc.

The sedimentary rocks associated with coal are accumulated sediments. Their constituents are of varied nature and their composition depends on the relative proportions of the materials of diverse origins. Those consisting mainly of the products of abrasion ("rock flour") and the washed residues of weathering (sand, silt, clay) are the clastic sediments. Those consisting mainly of the chemically or biochemically precipitated materials (calcium carbonate and silica) are nonclastic materials or sediments. Not uncommonly, the sediment has a multiple origin and is, in truth, a hybrid deposit. Usually the original composition is modified by reaction with materials in solution in the medium from which it was deposited or with those in solution in the ground waters with which it may later come in contact.

In sedimentary rock analysis, as many as 25 constituents may be determined and recorded. The most abundant or major constituents are stated as oxides, and any rock analysis of good quality records the content of at least nine or ten of these. They are silica, alumina, ferric and ferrous oxides, magnesia, lime, soda, potash and water. These rock elements occur typically as oxides, simple silicates, aluminates, fluorides, chlorides, and sulfides in either anhydrous or hydrated forms Pyrite is a naturally occuring disulfide. Pure pyrite contains 46.67% iron and 53.33% sulfur. The hardness of pyrite is 6.0–6.5 and the specific gravity about 5. Pyrite is very common in vein deposits with other sulfide minerals and quartz. It is common in sedimentary rocks, such as shale, coal and limestone.

An analysis of coal preparation provides a basis for explaining the various aspects of the invention disclosed herein. The conditions of coal separation relate generally to the whole of selected particulate separation in a liquid medium.

There are all kinds of associations of coal and rock ranging in an unbroken series from pure coal through coal with an increasingly higher proportion of inorganic impurities, continuing through rocks having a more or less carbonaceous content and finishing with pure rock. Accordingly, the specific gravities of these bodies form an unbroken series between the two extremes represented by pure coal and pure rock. Thus, in practice, the problem is to separate impure coal from more or less carbonaceous rock, and the arbitrary demarcation line is dependent on economic and experimental considerations.

Coal, as it appears in the ground, is never free from impurities. Some of the impurity is deemed "inherent", i.e. denoting impurity derived from the original substance of the plants and animals of which the coal is composed or impurity so dispersed in the coal that it cannot be separated by cleaning processes and can be seen only with the aid of a microscope. Larger impurities are pyrite ($FeS_2$) and marcasite (also $FeS_2$). Another impurity is in the thin beds called "partings," and occupies crevices or faults cutting through the coal at sharp angles, and is known as shale (slate), calcite ($CaCO_3$), sandstone, clay and roof rock.

With the onset of mechanical mining, run of mine coal become smaller and dirtier. In many mines more than a quarter of the coal brought to the surface was rejected as wasted, and, thus, grew the mountainous heaps of rock and coal which disfigure coal mining areas.

The specific gravity of coal depends in some degree upon its intrinsic impurities, and ranges between 1.2 and 1.5. Most of the extraneous impurities mined with the coal are much heavier than the coal itself, and separation of coarse coal can be effected by dense media methods.

All concentrating table cleaning involves considerable loss of coal, and is generally not considered efficient relative to capital cost and space requirements.

Very small sizes of run of mine coal can be cleaned by oil flotation methods. Coal to which much dirt adheres may be crushed to minus 50 mesh and fed into a bath of water through which air is bubbled. Oil, as a collector, spreads as a film over the surface of the coal particles. The oil-covered particles attract themselves to the entrained air bubbles and are carried to the surface of the bath. The rock particles, however, are preferentially wetted by water and not by oil, and so sink to the bottom of the bath. The froth on the surface of the bath is then removed and broken down to release the clean coal. See "Flotation Study of Refractory Coals," by Kenneth J. Miller, U.S. Bureau of Mines Report No. 8224.

Most substances are capable of existing in at least three forms or states of aggregation; namely, the solid state, the liquid state and the vapor state. Water is a familiar example. These forms, differing in internal structure and in physical properties, such as density, mobility, refractive index and heat content, constitute various phases of the substance. If a substance exhibits more than one crystalline form, as does sulfur, each of its polymorphic varieties is a distinct solid phase of the substance. The number of possible phases in a system containing more than one substance may include solutions in both the liquid and solid states and other phases that are, in general, chemical compounds resulting from the chemical combination and interaction of the components.

The materials of nature and of technology are either homogeneous (monophasic) or heterogeneous (polyphasic) systems. Ice is a single phase. A sample of water consisting of some liquid with its vapor is in two phases. A piece of granite generally contains three phases, being essentially a conglomerate of pieces of quartz, mica and feldspar. Each phase, although it may be present in separate pieces, is considered to be one homogeneous kind of matter. The phase is distinct in structure, though not always in chemical composition, from the other phases of the heterogeneous sample and is mechanically separable from them.

The conditions for the coexistence at equilibrium of various combinations of the possible phases of a system and for their formation and transformation, as controlled by variations in pressure, temperature and composition, constitute the subject of phase equilibriums. The principles of phase equilibriums find basic applications in practical problems of extractive metallurgy, such as disclosed herein, and, in general, in problems of physical and chemical separation.

When molecules come near enough to one another to influence each other, at least two forces are brought into play; one of attraction and one of repulsion. If molecules did not exert forces of attraction, they would not cohere, as they manifestly do in the liquid and crystalline states. Were there no forces of repulsion, the forces of attraction would be supreme, and nothing would prevent molecules from annihilating one another. Much as human conduct is determined by a conflict of loyalties, molecular behavior is, to a large extent, determined by the balance struck between the forces that tend to pull molecules together and those that tend to push them apart.

When two ions have charges of the same sign, their mutual energy and the force acting between them are positive, denoting repulsion. When the ions have charges of opposite signs, their mutual energy and the force acting between them are negative, denoting attraction. It is this force that accounts for the tenacity with which electrons in atoms are held to the positively charged nuclei.

Surface phenomena is that phenomena occurring at boundaries between phases of matter, such as between a solid and a liquid. Physical effect of surface phenomena include surface tension, adsorption, thin films, electrical double layers, wetting, adhesion, etc. These, in turn, bear on detergency, waterproofing, friction, flotation, corrosion, and electrode reactions. Stability of dispersions (colloidal), of emulsions, and of foams depend largely on surface properties.

In hydrocarbons, the interactions are weak and are due to dispersion forces resulting from momentary dissymetries in electron clouds about the atoms. Dispersion forces also contribute to this interaction in the case of liquids having stronger intermolecular attractions, such as water and alcohol. Such interactions are hydrocarbon bonds. The interaction between an interior carbon atom in diamond and each of four neighboring carbon atoms is like that between the two carbon atoms in ethane, $H_2C—CH_3$ (covalent bonds). The intermolecular forces holding liquids or crystals of hydrocarbons, water, alcohols or similar materials together—whether dispersion forces, dipole forces, orhydrogen bonds—are collectively characterized as weak.

Special types of adsorption are found at solid/liquid interfaces. Ions may be adsorbed by the solid, imparting a charge to the solid. This phenomenon is essential to the stability of most colloidal systems. Suitable organic ions can be adsorbed on particle surfaces to "waterproof" selectively wherein wet particles will settle out or separate from particles adsorbing the organic ions.

A special class of surface phenomena is furnished by films of long chain polar organic molecules on a water surface. The molecules referred to are such that a long hydrocarbon chain, usually containing from 14 to 30 carbon atoms, is attached to a small polar group such as carboxylic acid or alcohol group; stearic acid ($C_{17}H_{35}COOH$) is representative.

The long hydrocarbon chain renders the solubility of the material in water negligible. However, the polar group is attracted to water and, consequently, the material spreads readily on water to form a unimolecular film. The surface tension of the film-covered water is less than that of pure water. Therefore, a barrier placed in the path of the spreading film will experience a force which can be considered as a net "pull" in the direction away from the film, or as a "push" by the film. The difference between surface tensions of pure and film-covered water is called the "spreading pressure" of the film.

An electrical double layer results at the interface between the two phases when one phase is charged relative to the other. One phase may become charged relative to the other by adsorption of ions. Whether the charge on the surface is produced by electrons or ions, ions of opposite charge are drawn toward the surface by it, forming an atmosphere of countercharge near the surface. The combination of charge and countercharge is called the electrical double layer. Electrokinetic phenomenon and the stability of lyophobic sols, foams and emulsions are ultimately related to the structure of the electrical double layer.

The orientation of molecules adsorbed at an interface strongly determines wetting properties. Also, adhesion of two dissimilar materials to each other is closely related to wetting. From a molecular point of view, a joint interface will adhere strongly to each other if they have molecules which can interact strongly. Adhesives contain polar molecules or groups; thus, it is possible to secure good adhesion with polar surfaces such as metallic and nonmetallic compounds. On the other hand, it is difficult to secure good adhesion to nonpolar solids, such as coal.

An understanding in basic fluid mechanics is deemed important to an understanding of the invention.

Many flow phenomena are so complicated that a purely mathematical solution is impossible, incomplete or impractical. Thus, it is necessary to resort to experimental measurements. Dimensional analysis and dynamic similarities are two tools which have proved helpful in the organization, correlation and interpretation of experimental data. Dimensional analysis is a mathematical method useful in determining a convenient arrangement of variables in a physical relation and in planning systematic experiments. The first step is to list all the variables involved. This step may be the result of judgment or experience.

The actual dimensional analysis can be made by following a formal procedure:

$F = MLT^{-2}$ or $M = FT^2L^{-1}$ $L$ = length (dimensional)

$M$—mass (dimensional)

$F$ = force (dimensional)

$T$ = time (dimensional)

$L^2$ = area (dimensional)

$L^3$ = volume (dimensional)

$LT^{-1}$ = linear velocity (dimensional)

$LT^{-2}$ = acceleration (dimensional)

Force = mass × acceleration = dimensional relation

Buckingham's theorem can be used to organize variables in the smallest number of significant groups.

Open channel flow is more empirical than that of other aspects of fluid mechanics such as that of pipe flow. In order to obtain information about the flow around or through a structure called the prototype, it is often convenient and economical to experiment with a model of the prototype. Tests with models provide an advantage in research and design which cannot be obtained from theoretical calculations alone.

Dimensional analysis coefficients:

(a) Reynold's number
(b) Froude's number
(c) Weber's number
(d) other dimensionless numbers (other force ratios could be devised depending on the forces determining the particular flow)

Some variables:

(1) Flow pattern (magnitude and direction of velocity and acceleration) over, through or around the object.
(2) Pressure distribution and resulting forces on the object or its parts.
(3) Flow capacities and calibration of the various flow passages.
(4) Energy loss due to shear drag and pressure drag.
(5) Molecular properties at surfaces of separation; and reagent action.

PURPOSE OF THE INVENTION

The primary object of this invention is to provide a system for vertically classifying and extracting selected particulate material from mixtures of liquids and solids.

Another object of the invention is to provide a float product of a selected particulate material from a water medium which may be dried and dewatered with a significant reduction in the amount of energy required to effect such drying and dewatering.

A further object of the invention is to agglomerate fine particles of a selected particulate material as a float product.

Another object is to provide a novel float product including coal, water and oil, which may be used as a fuel source of energy.

A further object of this invention is to provide a novel reagent for treating a solid material disposed in a liquid carrier medium established in a continuous, substantially quiescent movement through a novel apparatus.

Another object of this invention is to provide a reagent useful to effect a novel method for floating a selected particulate material out of a mixture of liquids and solids.

Another object of the invention is to provide a method for separating a selected particulate material which has been treated with a reagent within a mixture of different solid materials in a liquid carrier medium.

A still further object of this invention is to provide a simplified apparatus useful to establish a free flow of material on the upper surface of a liquid carrier medium at a first rate of flow and to direct the remaining portions of the mixture at a second rate of flow away from the novel apparatus of this invention.

A still further object of this invention is to provide a method and an apparatus useful in recovering selected particulate material values located in refuse ponds and/or piles wherein the particulate material has an oxygen-controlled surface condition.

SUMMARY OF THE INVENTION

A reagent, an assembly and a method for separating selected particulate material comprise the system of this invention. The reagent includes a liquid hydrocarbon, a reducing material and an activator material. The apparatus comprises a trough shaped vessel having a mixture introducing end and a discharge end. The discharge end has an upper outlet means and a lower outlet means. The vessel has a structural configuration effective to provide a continuous, substantially quiescent movement of the mixture through the vessel. The upper outlet means is effective to provide an unimpeded discharge flow of material out of the vessel to cause a free flow of material at the upper surface of the liquid in the mixture. The lower outlet means is effective to provide an impeded discharge flow of a fluid material out of the vessel.

The method of the invention comprises mixing a chemical reagent with the mixture to form a resultant reaction mixture under substantially nonoxidizing or oxygen-free conditions. A continuous movement of the resultant reaction mixture is established through a flotation zone while maintaining substantially quiescent flow conditions during the continuous movement. A free flow of material collected at the upper surface of the liquid within the flotation zone is discharged separately from an impeded flow that is maintained at a lower flow rate than the upper free flow of material.

A feature of the invention is directed to the use of a polar solvent included with the chemical reagent of the invention for the purpose of promoting reactions involving ionization. This includes a high dielectric constant thereby resulting in establishing a high electric potential within the electrolyte or liquid carrier medium. More specifically, the polar solvent, acetonitrile(methyl-cyanide; and cyanomethane) is used in the processes of this invention. The polar solvent is added to the liquid hydrocarbon in an amount effective to promote the ionization which produces the necessary cation for placing a positive electric charge on the selected particulate material to be collected on the upper surface of the liquid carrier medium.

A further feature of the invention is the use of the apparatus and the method in the water circuits of existing prior art processes. That is, the coal preparation industry generally uses froth flotation equipment or hydrocyclone equipment for the purpose of separating bituminous coal fines from tailings. The liquid carrier medium is water. Particularly, bituminous coal fines having an oxygen-controlled surface condition cannot be recovered using the known prior art equipment. Consequently, significant amounts of oxidized bituminous coal are carried along by the water throughout the various water circuits. The specific apparatus of the present invention may be inserted in these water circuits in combination with existing prior art equipment. This enables the recovery of oxidized bituminous coal through the use of the reagent found to work under substantially quiescent flow conditions associated with the apparatus of the present invention.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 1 is a longitudinal cross-section of an apparatus made in accordance with this invention;

FIG. 2 is a perspective view of the apparatus of FIG. 1;

FIG. 3 is a top plan view of the device of FIG. 1;

FIG. 4 is a bottom plan view of the device of FIG. 1;

FIG. 5 is an elevational view at the discharge end of the device of FIG. 1;

DESCRIPTION OF SPECIFIC EMBODIMENTS

Figure 6:
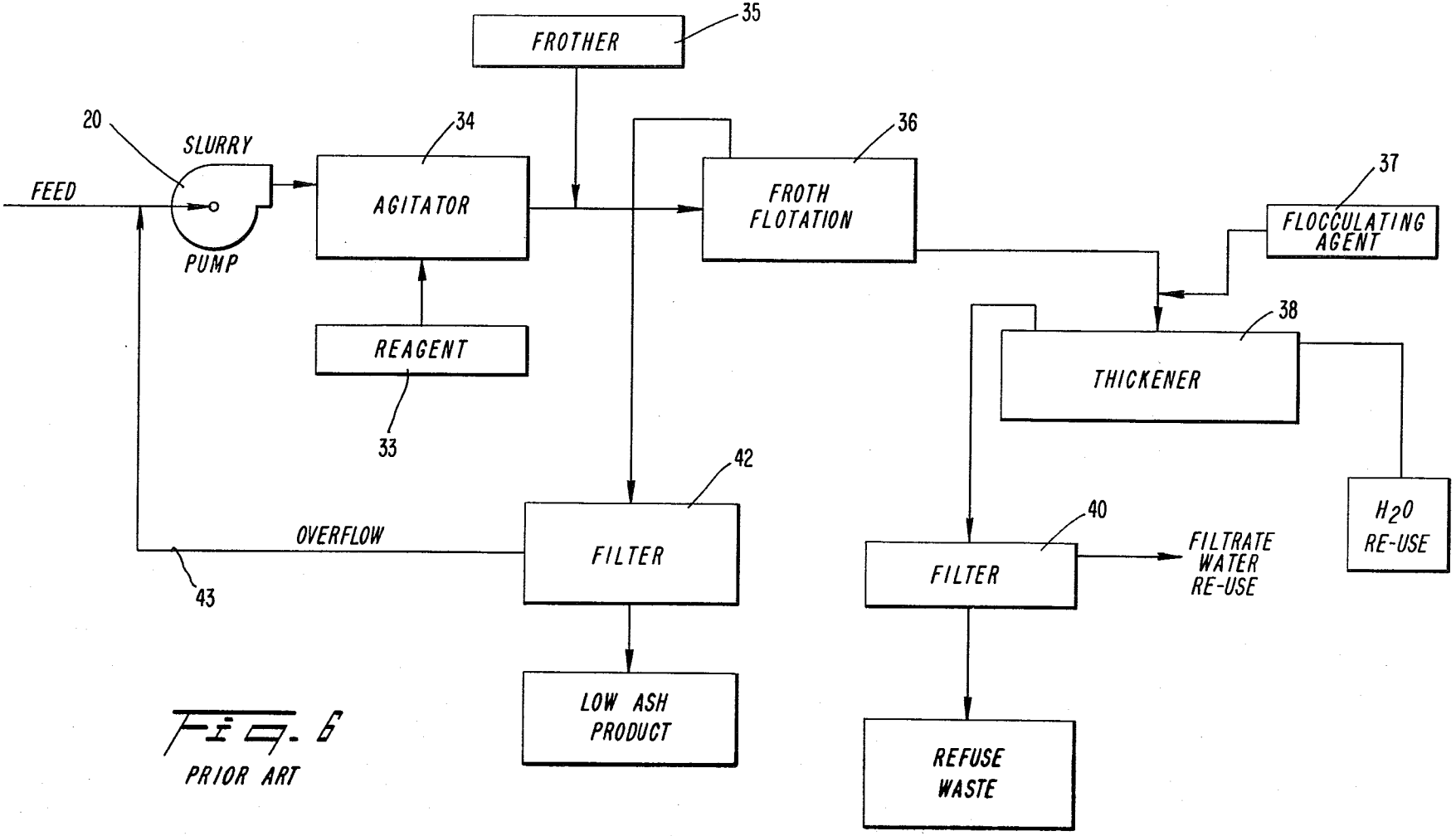
FIG. 6 PRIOR ART
FIG. 6 is a flow diagram for a typical prior art system for separating particulate material from a mixture of liquids and solids.

Mineral values being recovered according to this invention are contained in the solids portion of a mixture of liquids and solids. Such mixtures occur in any flotation or precipitation process. More specifically, flotation of bituminous and anthracite coal values, molybdenum sulfide values, graphite and sulfur are recovered from water as the liquid carrier medium.

The process and apparatus of the present invention takes advantage of a surface chemistry through the addition of a special chemical reagent which prepares selected particulate material so that it will collect on the upper carrier surface of a liquid medium in an unrestricted flow. A fundamental objective of the invention is to provide a free or unimpeded flow of the top layer of particulate material collected at the surface of the liquid carrier medium with no flow restriction being associated therewith. A further basic parameter is to maintain a broad carrier surface on top of a continuously moving body of liquid carrier material. Through the action of the special chemical reagent, the selected particulate material is caused to agglomerate or cling together and float to the top of the liquid carrier medium. It is, therefore, imperative that the upper discharge flow is unrestricted. The efficiency of the collection of selected particulate material is significantly reduced as the size of the upper carrier surface is increased. Alternatively, the more this area is reduced, the greater is the loss of efficiency.

In a copending application, Ser. No. 838,237, filed Sept. 30, 1977, various reagents have been disclosed for effecting flotation of bituminous coal having an oxygen-controlled surface condition. The reagents disclosed therein may be used with conventional equipment such as froth flotation apparatus which has been used for many years in the coal preparation industry.

More specifically, the special reagent of this invention prepares each of the selected particles of material by attaching a positive charge thereto. The basic idea is to cause the selected particle of material to reject the liquid carrier medium. In the case of particulate coal, a positive electric charge is carried onto the particle by the liquid hydrocarbon. The tailings composed of oxides, carbonates, and sulfates, are generally known to have a positive electrical charge. Thus, by placing a positive charge on the coal particle, there is a repulsion effect established between the coal and the tailings.

Furthermore, the liquid hydrocarbon will cause the coal particle to be further water rejecting.

As the mixture of chemical reagent and carrier medium passes continuously through the apparatus of the present invention, the liquid hydrocarbon being carried to the top forms a thin film across the carrier surface. The selected particulate material is forced out of the water or liquid carrier medium and onto the top of the hydrocarbon film. Thus, the liquid in the mixture being treated becomes truly a carrier medium. It has been found that the particles which have been collected in the flotation method and apparatus of this invention, actually cling together to form an agglomerate on top of the carrier surface.

Coal is one of the mineral values which is recoverable by the reagents and processes of this invention. However, the techniques of this invention are also applicable to other values such as molybdenum sulfide values, graphite and sulfur. Variations in reagents are also noted between bituminous and anthracite coal. Coal is emphasized in these specific embodiments.

Coals are not true minerals, but are organic compounds of many types formed from the remains of living trees, shrubs and plants that flourished millions of years ago during periods of uniformly mild and moist climate. Coal is a fosslized plant material. The nature of coal is dependent upon the specific original plant debris, upon the decay and weathering of the original plant debris prior to its burial and consolidation, and upon the effects of pressure, temperature, time and other subsequent geological conditions. Although coal is not a true mineral, its formation processes are similar to those of sedimentary rocks. Various coal seams can be studied and related geologically to the sedimentary rocks with which they are associated.

Coal consists of varying amounts of carbon and volatile material, and of impurities such as sulfur, phosphorous, incombustible rock materials and moisture. The carbon compounds in the plants which later became coal were manufactured in the cells through the action of chlorophyll in the leaves. The carbon originated in the carbon dioxide and water content of the air, and the energy necessary for the transformation originated as solar energy in the form of heat from the sun.

The degree of coalification (rank) of coals is determined by chemical methods called proximate analysis. Proximate analysis determines how much moisture, volatile matter, and fixed carbon the coal contains. Heating value, coking ability and weathering properties classify the lower ranking coals. Coal rank increases with the amount of fixed carbon and decreases with moisture and volatile matter content.

Chemically, the major components of coal are hydrocarbons combined in molecules of different sizes and arrangements. The carbon atoms in the hydrocarbon molecules may be linked in two different ways, forming either a ring or a chain. Moreover, each of the carbon atoms may have either a full or only a partial complement of hydrogen atoms, forming saturated and unsaturated molecules.

The inherent ash comprises an inorganic oxide, carbonate or silicate. This inherent ash has an affinity for water. Consequently, it holds water causing the drying of fine coal to be extermely difficult and a major cost item in the coal industry. Through the use of the special reagent of this invention, the selected particulate material, namely, coal, is driven to the surface where there is an unrestricted free flow of material being discharged out of a trough shaped vessel. Experimentally, it has been shown that where bituminous coal has been driven to the surface of a liquid carrier medium (water) through the use of the special chemical reagent, the addition of negatively charged water will cause the particulate material in the float product to sink. That is, the agglomerated effect caused by the electrical-chemical bond can be broken through the addition of water having a negative electrical charge. It is believed that electrostatic coalescence is the mechanism for the agglomeration effect on the particles collected on top of the thin hydrocarbon film covering the liquid carrier medium.

A very basic feature of this invention is to establish a nonoxidizing or substantially oxygen-free environment within the liquid carrier medium where the selected particulate material is being prepared for final separation. This oxygen-free environment is combined with the unrestricted flow requirement existing on the carrier surface of the liquid carrier medium.

To attain the proper environment for the desired separation, a continuous, substantially quiescent flow is established within a flotation zone. To be substantially quiescent means to have a minimal amount of turbulence which would disturb the relationship between the body of liquid medium, the thin film of hydrocarbon on the surface thereof and the float product collected on said film. The substantially quiescent flow conditions are effective to allow the appropriate intermolecular activity of repulsion and attraction take place to separate the selected particulate material from the tailings. The intermolecular activity of repulsion and attraction propels the selected particulate material upwardly and causes coalescence on the surface of the liquid medium. Additionally, the substantially quiescent flow conditions prevent the inclusion of free oxygen from being introduced into the mixture.

A specific example of the reagent includes a zinc thiophosphate compound mixed with a liquid hydrocarbon. It is theorized that as soon as the reagent is mixed together with the liquid carrier medium and solid material, the ionization of the zinc thiophosphate takes place. The sulfur combines with any oxygen associated with the surface of the bituminous coal fine. Once this bond is broken, the hydrocarbon of the reagent wets the particle and carries the zinc cation along to form a positive charge on the bituminous coal fine. One of the by-products of this reaction is the generation of hydrogen sulfide gas. The zinc cation constitutes an activator material present in an amount sufficient to establish an electrostatic charge on the selected particulate material within the reducing environment. The liquid carrier medium is water having a pH of less than 7. The process has been effectively carried out with the water in pH range of 4 to 5.

The combination of the use of the reagent of the invention in a continuously moving mixture of liquid carrier medium and solids, provides a greatly simplified system for separating coal fines from the ash content associated therewith. A typical prior art flow diagram is shown in FIG. 6. A slurry pump 20 feeds the mixture of liquids and solids into an agitator 34 where a prior art reagent 33 is added. A frother 35 is then added after the agitation takes place. The resultant mixture is then introduced into a froth flotation machine 36. The float product is directed off the top of the froth flotation equipment 36 and directed to filter 42. A low ash product is obtained on one hand and the overflow 43 is recycled as shown.

The effluent from the froth flotation device 36 is combined with a flocculating agent 37 and directed to a thickener 38. The solids portion is taken off the top of thickener 38 and sent to filter 40. Filtered water is reused from filter 40. The refuse waste in a typical froth flotation system for floating bituminous coal, contains 30–40% of its solid material as oxidized coal. This waste is dumped into either refuse ponds or piles as a matter of course. Now, as a result of this invention, the oxidized coal that has been collecting in these refuse ponds and piles for numerous years can be recovered for the first time.

Another feature of this invention is the ability to clarify the water being used as the liquid carrier medium. Numerous water circuits in prior art flotation systems are clogged with materials which are not being separated out with existing reagent procedures. The method of this invention both effects a greater degree of flotation and the capability of total water clarification. If the water circuit is closed, water clarification avoids abrasive wear on the equipment and consequent maintenance problems. If the water circuit is open, the present environmental water pollution problem is obviated.

The simplicity of the equipment used on conjunction with this invention is shown in FIGS. 1–5, and 7. The trough shaped vessel, generally designated 10, has a mixture introducing end 14 and a discharge end which includes an upper outlet 15 and a lower outlet 17. The discharge end is effective to discharge an amount of material from the vessel at a rate sufficient to establish continuous, substantially quiescent movement of the mixture introducing end 14 to the discharge end of vessel 10.

In this embodiment, the side walls 12 and 13 are straight and parallel with respect to each other. A flow barrier portion 18 extends between the upper outlet 15 and the lower outlet 17. The upper outlet 15 defines the cross-section of an upper open channel portion and the lower outlet 17 defines a lower constricted flow portion. The upper open channel portion includes upwardly extending side walls laterally displaced with respect to each other to form a carrier surface on the top of the electrolyte or liquid carrier medium. Side walls 12 and 13 extend upwardly in amounts sufficient to contain the selected particulate material disposed along the carrier surface and, further, unrestrictedly direct the particulate material to the outlet 15.

The vessel 10 has a structural configuration effective to provide a continuous, substantially quiescent movement of the mixture through vessel 10 while it is in a flotation zone. The continuous movement is based upon having substantially the same amount of material being discharged from vessel 10 as is being introduced at the mixture introducing end. Thus, as an example, if the material is being supplied to vessel 10 at a thousand gallons per minute, the discharge end is designed to accommodate the solid portion being recovered at the top of the surface and the effluent material to be discharged through the lower discharge outlet 17.

Typically, in a bituminous coal preparation process, 70% of the mixture is liquid and 30% is solid. That portion of the selected particulate material in the solid would be accommodated by the upper outlet 15 as it is carried along by the liquid. The remaining effluent would be discharged through the lower outlet 17 at a rate less than the rate of flow through the upper outlet 15.

It is possible that the vessel 10 could, by itself, be placed in the water discharge outlet of the froth flotation device 36 as shown in FIG. 6. Thus, the vessel 10 would replace the thickener 38. The reagent of this invention would be added to the discharge from the froth flotation device 36 in place of the flocculating agent 37. In this manner, the continued loss or discharge of oxidized bituminous coal as refuse waste would be completely obviated.

In another situation, it would be possible to use the vessel 10 or its equivalent to recover selected particulate material from numerous waste or refuse ponds and piles containing various kinds of mineral values. These refuse sites would include such values as oxidized bituminous coal, oxidized molybdenum disulfide and anthracite coal fines.

A reagent concentrate having the following composition was prepared for use in a prototype of vessel 10:

| Chemical Constituent | Amounts (Parts by Volume) |
|---|---|
| Carbon disulfide | 50 parts |
| Zinc ethylenebis(dithiocarbamate) | 24 parts |
| Phosphorous pentasulfide | 25 parts |
| Acetonitrile | 1 part |

The solid materials were first dissolved in the carbon disulfide. The acetonitrile was then added to the concentrate (or to the liquid hydrocarbon). One part of the concentrate was then mixed with one part of mineral oil having a paraffinic base. The resultant reagent was then mixed with the liquid body of water in which was contained butuminous coal fines having an oxygen-controlled surface condition and tailings.

Upon mixing the reagent in the liquid body, the liberated bituminous coal particles were collected in and upon the film of liquid hydrocarbon formed on the surface of the water. The float product being carried by the liquid carrier medium included coal which had formerly had an oxygen-controlled surface condition. The rate of flow through vessel 10 was about 80 gallons per minute and the pH was in the range of 4–5. The float product had a density greater than water or about 1.4–1.5.

The bulk for the mixture of liquids and solids in the specific embodiment for separating bituminous coal fines was about 2.1. The density of bituminous coal is approximately 1.4. The density of anthracite coal fines is about 1.65. The highly reducing component in the specific enbodiment is phosphorous. The sulfur in the chemical reagent is in place of oxygen which is present in prior art chemical reagents. The sulfur in solution becomes oxidized. The zinc cations are ionized and carried by the mineral oil having a paraffinic base onto the particles of coal. It is emphasized that both oxidized and nonoxidized coal or mineral values are collected in the float product in accordance with this invention.

The same chemical reagent used to float bituminous coal fines down to a mesh size of 100 by 0 has also been used to recover molybdenum sulfide values. The molybdenum sulfide is in the form of molybdenum disulfide and has been subjected to extensive oxygen environments such as air and water. Consequently, the molbdenum disulfide also is subject to having an oxygen-control surface condition. These fines have been collected in large tailings ponds. As a result of the discoveries associated with this particular invention, however, these formerly unrecoverable metal values can now be collected in a float product.

A source of a zinc dithiophosphate compound is commercially available as Lubrizol 5110. To recover anthracite coal, an anti-form additive commercially available as Ocenol 2 from the Dupont Corporation and a nonionic polyelectrolyte commercially available as Mogul from the Mogul Corporation has been used in combination with the Lubrizol 5110. The combination forms a chemical reagent which floats anthracite coal and effects clarification of the water being used as the liquid carrier medium.

A further special reagent useful in floating anthracite coal includes, $\frac{1}{4}$ part zinc chloride (1% zinc chloride, 99% $H_2O$), 1 part of Exxon Cutwell 40, and the balance water.

A further special reagent made in accordance with this invention for floating anthracite coal includes by volumne percent 98% Lubrizol 5110 (zinc dithiophosphate), 1% Ocenol 2 (an anti-foam additive from DuPont), and 1% Mogul 9043N (a nonionic polyelectrolyte from Mogul Corporation). The amount of reagent is added in a proportion of about 10 parts per million to the mixture of liquids and solids. In these particular examples, the mixture analysis included 90% water and 10% solids. One of the features and unexpected results of this invention, the total amount of water in the mixture can be significantly reduced. This could possibly be reduced as much as 50% water to 50% solids in the final mixture. The obvious savings with respect to water being used in the production of the mineral values is new and extremely important from an envirionmental standpoint. As noted, the addition of these reagents is used to recover anthracite coal fines which include previously unrecoverable anthracite coal fines having an oxygen-controlled surface condition.

Lubrizol 5110 is composed of an organic zinc dithiophosphate in an amount greater than 75% by weight. The amounts, by weight, of the zinc, sulfur and phosphorous are as follows:

zinc 7.6 to 8.7
sulfur 14.75 to 16.25
phosphorous 7.0 to 8.0

Figure 7:
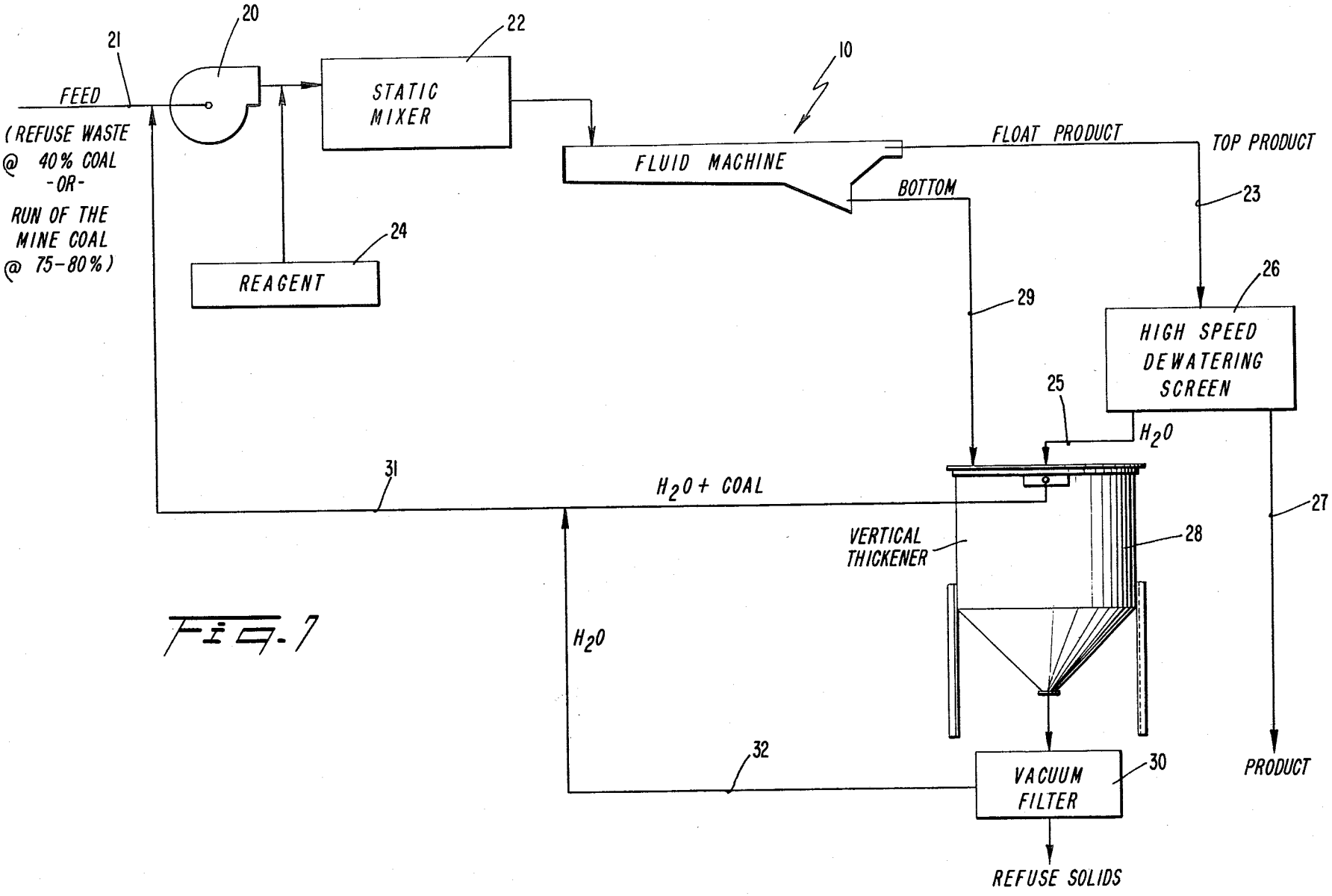
FIG. 7 is a flow diagram diagrammatically showing an assembly made in accordance with this invention.

A complete system made in accordance with this invention is shown in FIG. 7. Feed supply 21 is introduced by pump 20 through a static mixer 22. A reagent introducing device 24 introduces a reagent made in accordance with this invention to the feed supply ahead of the static mixer 22. A static mixing device as disclosed in U.S. Pat. No. 3,918,688 may be used for the static mixer 22. It is intended that the reagent and feed supply are adequately mixed under substantially nonoxidizing or oxygen-free conditions. There is a significant amount of turbulence in static mixer 22. However, this form of turbulence does not introduce oxygen into the mixture being treated. The mixture of liquids and solids having the reagent added thereto is then introduced into the fluid machine 10 at its mixture introducing end. As stated, vessel 10 is effective to establish substantially quiescent flow conditions during movement from the mixture introducing end to the discharge end of the vessel.

The angle of inclination in the bottom of vessel 10 must be sufficient to sweep the tailings out of the second discharge means along with the impeded flow of liquid medium. The inclined portion 19 is at an angle that is greater than 22° from the horizontal.

The float product is sent directly to a high speed dewatering screen 26 via the line 23. The coal product 27 is then separated from the water 25 which is directed to the vertical thickener 28 as shown. The effluent from the fluid machine 10 is discharged in an impeded discharge flow and directed to the vertical thickener 28 via line 29.

Vertical thickener 28 is composed of a vertical settling tank wherein the solid portion of the effluent is rapidly, chemically precipitated out of the water. Appropriate polyelectrolytes are used to effect the clarification of the water by precipitating out the tailings portion coming into the thickener 28 via line 29. Any further coal which floats as a result of treatment in the vertical thickener will be recycled to feed 21 via line 31. The remaining portion of the effluent will be discharged from vertical thickener 28 to a vacuum filter 30 where the water is separated from refuse solids. Water travels via line 30 back into the system as shown.

While the method and apparatus for separating selected particulate materials from a mixture of solids and liquids has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of the invention, what is claimed is:

1. An apparatus for separating selected particulate material from a mixture of liquids and solids, said apparatus comprising:

(a) a trough shaped vessel having a mixture introducing end and a discharge end, (b) said discharge end having an upper outlet means and a separate downwardly sloping lower outlet means spaced from and ahead of the upper outlet means in the direction of flow of liquid therein, (c) said upper and lower outlet means having proportions such that they discharge an amount of material from said vessel at a rate sufficient to establish continuous movement of the mixture from said mixture introducing end to said discharge end of said vessel, (d) said vessel having portions such that they establish substantially quiescent flow conditions intermediate the introducing end and discharge end during said continuous movement, (e) said vessel having additional proportions such as to maintain said continuously moving mixture within said vessel for a period of time sufficient to allow a selected particulate material to collect at the upper surface of the mixture, (f) said upper outlet means having additional proportions such as to provide a discharge flow of liquid material out of said vessel to cause a free flow of said selected particulate material at the upper surface of the liquid in said mixture, and (g) said lower outlet means having additional proportions such as to provide an impeded discharge flow of effluent material out of said vessel, whereby the combined amounts of material leaving the upper and lower outlet means is substantially equal to the amount entering the introductory end.

2. An apparatus as defined in claim 1 wherein a flow barrier portion extends between the upper outlet means and the lower outlet means.

3. An apparatus as defined in claim 1 wherein said discharge end includes an upper open channel portion forming a part of said upper outlet means and a lower constricted flow portion forming a part of the lower outlet means.

4. An apparatus as defined in claim 3 wherein said upper open channel portion includes upwardly extending side walls laterally displaced with respect to each other to form a carrier surface therebetween.

5. An apparatus as defined in claim 4 wherein the measured distance between the side walls at the outlet means being at least as great as the smallest measured distance between the walls.

6. An apparatus as defined in claim 4 wherein said side walls are straight and parallel with respect to each other.

7. An apparatus as defined in claim 4 wherein said side walls extend upwardly in amounts sufficient to contain the selected particulate material disposed along the carrier surface and unrestrictedly direct said particulate material to the outlet means.

8. An apparatus as defined in claim 1 wherein said vessel includes a flow barrier portion extending between the upper outlet means and the lower outlet means, said vessel proportions for discharging material includes an upper open channel portion and a lower constricted flow portion.

9. An assembly for separating selected particulate material from a mixture of liquids and solids, said assembly comprising:

(a) means for introducing a chemical reagent into said mixture to prepare said selected particulate material in said liquids for separation from said mixture, (b) means for containing and admixing the mixture with said chemical reagent under substantially non-oxidizing conditions while said selected particulate material is being prepared for separation, (c) means for supplying the mixture to said containing means, (d) means for separating said selected particulate material from said mixture at a first location on said containing means, (e) means for delivering said mixture depleted of said particulate material from said containing means to a second separating means (f) means for introducing a further chemical reagent into said depleted mixture for further separation of particulate material at said second separating means (g) said second separating means including a trough shaped vessel having a mixture introducing end and a discharge end and being disposed to receive said mixture including said further chemical reagent at said mixture introducing end thereof, (h) said discharge end having separate spaced apart upper outlet means and downwardly sloping lower outlet means spaced from and ahead of the upper outlet means in the direction of flow of liquid therein, (i) said discharge end having proportions such that they discharge an amount of material from said vessel at a rate sufficient to establish continuous movement of the mixture from said mixture introducing end to said discharge end of said vessel, (j) said vessel having proportions such that they establish substantially quiescent flow conditions intermediate the introducing end and discharge end during said continuous movement, (k) said vessel having additional proportions such as to maintain said continuously moving mixture within said vessel for a period of time sufficient to allow a selected particulate material to collect at the upper surface of the mixture, (l) said upper outlet means having additional proportions such as to provide a discharge flow of liquid material out of said vessel to cause a free flow of said selected particulate material at the upper surface of the liquid in said mixture, and (m) said lower outlet means having additional proportions such as to provide an impeded discharge flow of effluent material out of said vessel, whereby the combined amounts of material leaving the upper and lower outlet means is substantially equal to the amount entering the introductory end.

10. An assembly as defined in claim 9 wherein a flow barrier portion extends between the upper outlet means and the lower outlet means.

11. An assembly as defined in claim 9 wherein said discharge end includes an upper open channel portion forming a part of said upper outlet means and a lower constricted flow portion forming a part of said lower outlet means.

12. An assembly as defined in claim 11 wherein said upper open channel portion includes upwardly extending side walls laterally displaced with respect to each other to form a carrier surface therebetween.

13. An assembly as defined in claim 12 wherein the measured distance between the side walls at the outlet means being at least as great as the smallest measured distance between the walls.

14. An assembly as defined in claim 12 wherein said side walls are straight and parallel with respect to each other.

15. An assembly as defined in claim 12 wherein said side walls extend upwardly in amounts sufficient to contain the selected particulate material disposed along the carrier surface and unrestrictedly direct said particulate material to the outlet means.

16. An assembly as defined in claim 9 wherein said vessel includes a flow barrier portion extending between the upper outlet means and the lower outlet means, said vessel proportions for discharging material includes an upper open channel portion and a lower constricted flow portion.

17. An assembly as defined in claim 9 wherein said first location on said containing means includes a froth flotation cell or a hydrocyclone.

18. An assembly for separating selected particulate material from a mixture of liquids and solids, said assembly comprising:

(a) means for introducing a chemical reagent into said mixture to prepare said selected particulate material in said liquids for separation from said mixture, (b) a containing means for containing said reagent with said mixture (c) means for supplying the mixture to said containing means (c') said supplying means including static mixing means for mixing said chemical reagent with said mixture (d) a trough shaped vessel having a mixture introducing end and a discharge end (d') said discharge end having spaced apart upper outlet means and a lower outlet means (e) means for delivering the reagentized mixture to said introducing end of said trough shaped vessel (f) said vessel having a structural configuration having proportions such as to provide a continuous substantially quiescent movement of the mixture through said vessel from the introductory end to the discharge end, (g) said upper outlet means having proportions such as to provide a discharge flow of liquid material out of said vessel to cause a free flow of said selected particulate material at the upper surface of the liquid in said mixture, and (h) said lower outlet having proportions such as to provide an impeded discharge flow of effluent material out of said vessel, whereby the combined amounts of material leaving the upper and lower outlet means substantially equals the amount entering the introductory end.

19. An assembly as defined in claim 18 wherein a vertical thickener means receives the effluent material from said trough shaped vessel to effect further separation of said selected particulate material.

20. An apparatus for separating selected particulate material from a mixture of liquids and solids, said apparatus comprising:

(a) a trough shaped vessel having a mixture introducing end and a discharge end, (b) said discharge end having spaced apart upper outlet means and downwardly sloping lower outlet means spaced from and ahead of the upper outlet means in the direction of flow of liquid, (c) said vessel having a structural configuration and proportions such that they provide a continuous substantially quiescent movement of the mixture through said vessel from the introductory end to the outlet end, whereby a selected particulate material may collect at the upper surface of said liquid, (d) said upper outlet means having proportions such as to provide a discharge flow of liquid material out of said vessel to cause a free flow of said selected particulate material at the upper surface of the liquid in said mixture, and (e) said lower outlet means having proportions such as to provide an impeded discharge flow of effluent material out of said vessel whereby the combined amounts of material leaving the upper and lower outlet means substantially equals the amount entering the introductory end.

* * * * *

UNITED STATES PATENT AND TRADEMARK OFFICE

CERTIFICATE OF CORRECTION

PATENT NO. : 4,222,857

DATED : September 16, 1980

INVENTOR(S) : JAMES R. McCARTHY

It is certified that error appears in the above-identified patent and that said Letters Patent are hereby corrected as shown below:

Column 3, line 20, "become" should read --became--.

Column 12, line 35, "butuminous" should read --bituminous--.

Claim 1(d), column 14, line 46, "portions" should read --proportions--.

Signed and Sealed this

*Twentieth* Day of *January 1981*

[SEAL]

*Attest:*

RENE D. TEGTMEYER

*Attesting Officer*

*Acting Commissioner of Patents and Trademarks*